US006840811B2

(12) United States Patent
Chen

(10) Patent No.: US 6,840,811 B2
(45) Date of Patent: Jan. 11, 2005

(54) DIGITAL CARD LINKER

(76) Inventor: Chien-Yuan Chen, Fl. 5-1, No. 8, Sec. 3, Shuang-Shi Rd., Banchiau City, Taipei County (TW)

( * ) Notice: Subject to any disclaimer, the term of this patent is extended or adjusted under 35 U.S.C. 154(b) by 0 days.

(21) Appl. No.: 10/366,511

(22) Filed: Feb. 14, 2003

(65) Prior Publication Data

US 2004/0161952 A1 Aug. 19, 2004

(51) Int. Cl.[7] ..... H01R 24/00
(52) U.S. Cl. ..... 439/637
(58) Field of Search ..... 439/630, 637

(56) References Cited

U.S. PATENT DOCUMENTS 6,524,137 B1 * 2/2003 Liu et al. ..... 439/638

6,702,619 B2 * 3/2004 Kuroda et al. ..... 439/637

* cited by examiner

*Primary Examiner*—Khiem Nguyen

(57) ABSTRACT

A connector for connecting with a digital card includes a card receiver and a plurality of contact pins. The card receiver has an opening at the front side thereof to receive the digital card and the contact pins are arranged as upper contact pins and lower contact pins being opposite to each other disposed in the card receiver. The distance between the upper contact pins and the lower contact pins is set being smaller than the thickness of the digital card. The card receiver at the rear side thereof provides a row of upper through holes for being inserted with the upper contact pins and the bottom of card receiver is provided with a row of lower through hole with a row of grooves extending to the rear side of the card receiver for being inserted with the lower contact pins. Hence, the digital card can be held in place tightly and digital signal can be transmitted via the contact pins effectively and steadily.

4 Claims, 2 Drawing Sheets

DIGITAL CARD LINKER

BACKGROUND OF THE INVENTION

1. Field of the Invention

The present invention is related to a connector for connecting a digital card and particularly to a connector for a digital card being able to contact with a computer.

2. Brief Description of Related Art

The digital card is a storage media with lightness, thinness, smallness and shortness. In addition, the digital card has features such as high compatibility, low cost, large storage capacity, high transmission velocity and high confidence. The digital card adopts open structure and can be applied to mobile phones, personal digital assistants, computers and various data storage and transmission media.

The performance of the digital card is getting powerful but the contact plates of the digital card for transmitting signals to the computer are not enough for matching the powerful performance. In order to overcome the preceding problem, it is not a good way to reduce the size of each contact plate and increase the number of the contact pieces because small area of each of the contact pieces affects stability of signal transmission. Hence, how to increase the number of the contact plates without decreasing the area of each of the contact pieces so as to match the getting powerful performance of the digital card is a subject worth us to care.

SUMMARY OF THE INVENTION

A main object of the present invention is to provide a connector for connecting a digital card and the connector includes a box type card receiver and a plurality contact pins being oppositely disposed in the card receiver for being used for the single side digital card even for double sides single row digital card.

Another object of the present invention is to provide a connector for connecting a digital card with which the digital card can be joined between the contact pins steadily once the digital card is inserted into the card receiver.

The other objects and detail structure of the present invention can be described in further detail hereinafter with reference to the accompanying drawings.

DETAILED DESCRIPTION OF THE INVENTION

Figure 2:
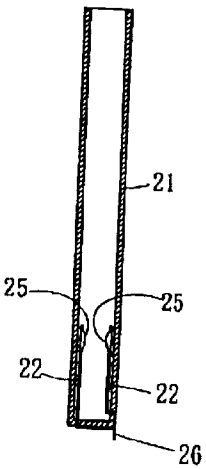
FIG. 2 is a sectional view of the connector shown in FIG. 1.
Figure 1:
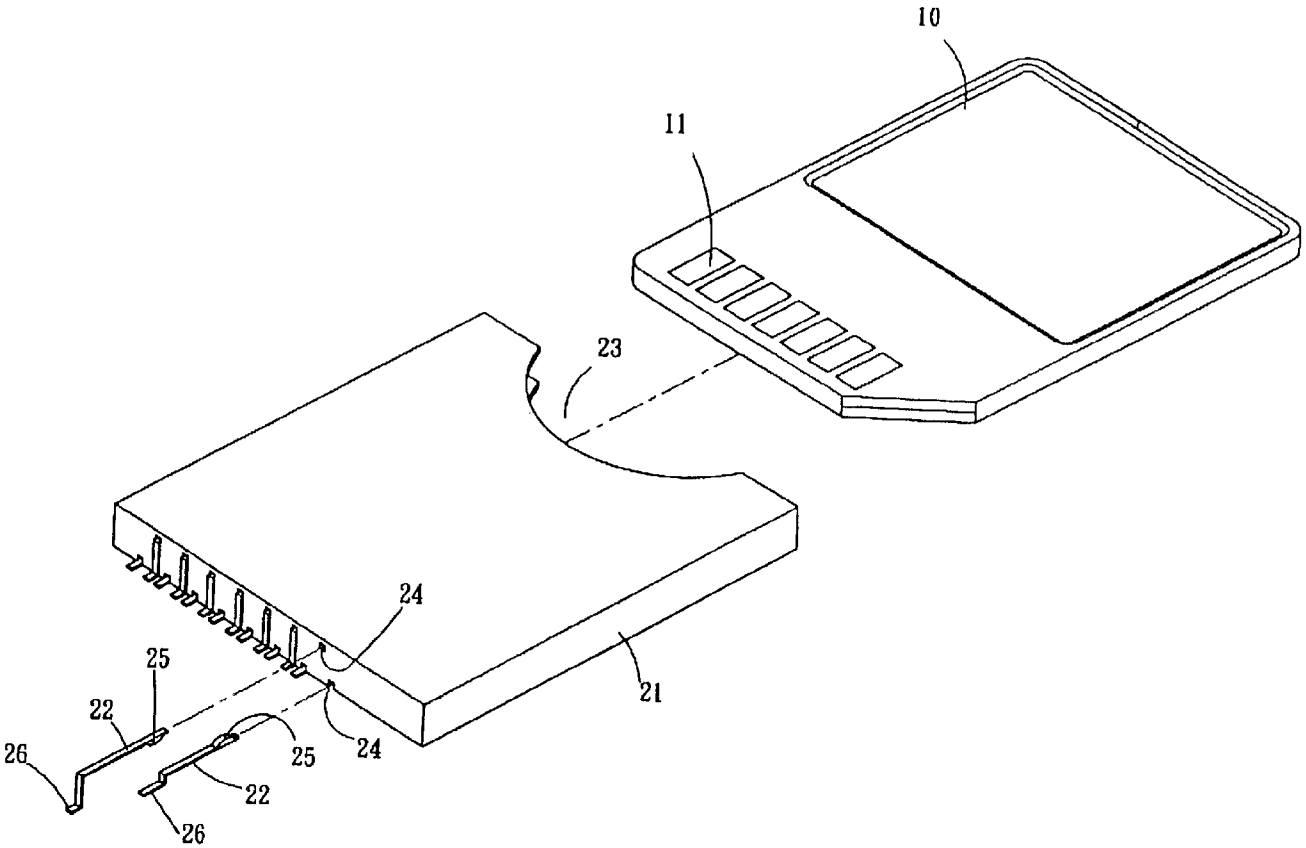
FIG. 1 is a perspective view of the connector according to the present invention in which an upper contact pin and a lower contact pin being detached from the connector.

Referring to FIGS. 1 and 2, a connector 20 for connecting a digital card 10 according to the present invention includes a box shaped card receiver 21 and a plurality of contact pines 22. The card receiver 21 provides the front side thereof an open side for being inserted with the digital card 10 and the open side has a semicircular recess 23 for facilitating the card being inserted in and taken out. A row of upper through holes 24, which are disposed at the upper part of the rear side of the card receiver 21, and a row of grooves, which are disposed at lower part of the rear side of the card receiver 21 corresponding to the through holes. The grooves extends forward a distance along the bottom and a row of lower through holes 24 are disposed at the bottom of the card receiver 21 corresponding to the upper through holes and communicating with the grooves respectively.

Each of the contact pins 22 has a front end 25 with a projection for contacting with the contact plates of the digital card 10 and a bent downward rear end 26 for being welded to a circuit board. Part of the contact pins 25, which are inserted into the card receiver 21 via the upper through holes, constitute upper contact pins and rest of the contact pins, which are inserted into the card receiver 21 via the lower through holes, constitute lower contact pins. The upper contact pins and the lower contact pins in the card receiver 21 are opposite to each other with the projection of the front end of each of the contact pins 25 facing to each other.

Figure 3:
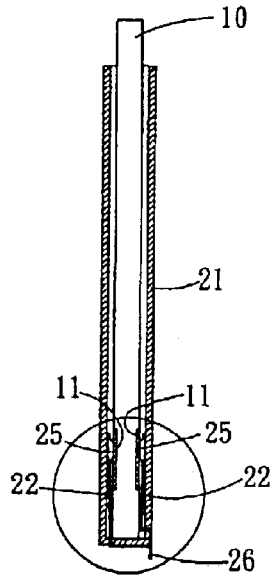
FIG. 3 is a sectional view illustrating the connector of the present invention being inserted with the digital card.
Figure 4:
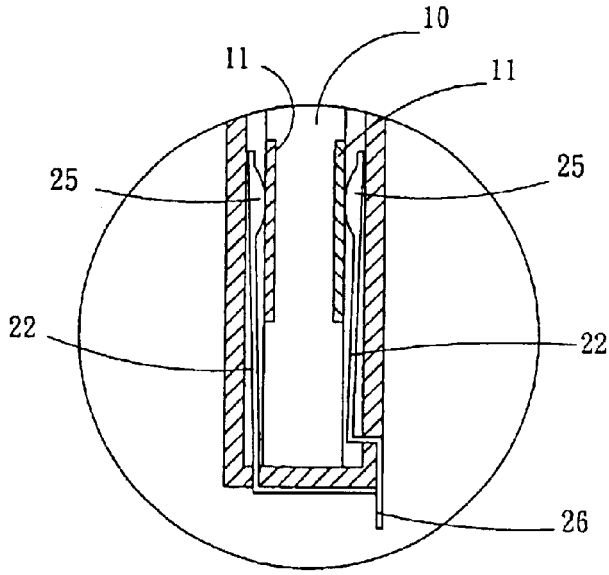
FIG. 4 is a fragmentary sectional view illustrating an enlarged part of a circled part of the connector.

Referring to FIGS. 3 and 4, the contact pins 22 are made of material with good elasticity and the distance between the upper contact pins and the lower contact pins is smaller than the thickness of the digital card so that when the digital card 10 is inserted into the card receiver 21, the upper and lower contact pins can keep contact with the both lateral sides of digital card 10 tightly and terminal plates 11 disposed on the digital card 10 can be held effectively for performing digital signal transmission.

Alternatively, the contact pins 22 can be joined to the card receiver 22 by way of plastic injection mold so that the contact pins 22 can be placed in the mold hole before the card receiver 22 is formed with the plastic injection mold integrally with the contact pins 25.

Because the distance between the upper contact pins and the lower contact pins can set for the digital card with either single side and single row or double sides and single row. Hence, the connector of the present invention is suitable for connecting with both the old and new type digital cards.

It can be realized from the preceding explanation of the preferred embodiment that there are upper contact pins and lower contact pins with specific arrangement so that the digital card can be held more tightly and signal can be transmitted via the digital card with better stability.

What is claimed is:

1. A connector for a digital card, comprising:

a card receiver, providing an opening at the front side thereof; and a plurality of elastic pieces, being mounted to the card box via the rear side of the card receiver;

characterized in that the card receiver provides a row of upper through holes, which are disposed at the upper part of the rear side thereof, and a row of grooves, which are disposed at lower part of the rear side thereof corresponding to the through holes; the grooves extends forward a distance along the bottom and a row of lower through holes are disposed at the bottom of the card box corresponding to the upper through holes and communicating with the grooves respectively; and the elastic pieces are arranged as a plurality of upper elastic pieces and a plurality of lower elastic pieces, wherein the upper elastic pieces are inserted into the card receiver via the upper through holes and the lower elastic pieces are inserted into the card receiver via the lower through holes in a way of the upper elastic pieces corresponding to the lower elastic pieces and a distance between the upper elastic pieces and the lower elastic pieces is smaller than the thickness of the digital card.

2. The connector for a digital card as defined in claim 1, wherein each of the elastic pieces has a projection at the front end thereof.

3. The connector for a digital card as defined in claim 1, wherein each of the upper elastic pieces is bent downward at the rear part thereof, which is outside the rear side of the card box and each of the lower elastic pieces is bent downward at the rear part thereof to extend outward through the corresponding lower through hole.

4. The connector for a digital card as defined in claim 1, wherein the contact pins can be integrally joined to the card receiver by way of injection mold.

* * * * *